US008091308B2

(12) United States Patent
Westmoreland et al.

(10) Patent No.: US 8,091,308 B2
(45) Date of Patent: Jan. 10, 2012

(54) DRY STACK INSULATED BUILDING BLOCKS

(76) Inventors: Austin P. Westmoreland, Orem, UT (US); Shane A. Westmoreland, Orem, UT (US); Wynn L. Westmoreland, Orem, UT (US)

( * ) Notice: Subject to any disclaimer, the term of this patent is extended or adjusted under 35 U.S.C. 154(b) by 0 days.

(21) Appl. No.: 11/520,327

(22) Filed: Sep. 13, 2006

(65) Prior Publication Data

US 2008/0060300 A1 Mar. 13, 2008

(51) Int. Cl.
*E04B 1/74* (2006.01)

(52) U.S. Cl. ..... 52/405.4; 52/309.12; 52/606

(58) Field of Classification Search ..... 52/405.8, 52/405.4, 309.12, 606
See application file for complete search history.

(56) References Cited

U.S. PATENT DOCUMENTS 4,059,362 A * 11/1977 Smith ..... 404/6
4,380,887 A * 4/1983 Lee ..... 52/405.1
4,450,662 A * 5/1984 Melchiori, Jr. ..... 52/223.13
4,748,782 A * 6/1988 Johnson et al. ..... 52/405.4
4,769,964 A 9/1988 Johnson et al. ..... 52/405
5,062,244 A * 11/1991 Ducharme ..... 52/98
5,096,333 A * 3/1992 Bassett ..... 405/244
5,349,798 A * 9/1994 Gross ..... 52/405.1
5,355,647 A 10/1994 Johnson et al. ..... 52/503
5,861,116 A * 1/1999 Mandich ..... 264/35
6,033,023 A * 3/2000 Strassner et al. ..... 297/397
6,513,293 B2 * 2/2003 Miller ..... 52/405.1
2001/0022057 A1 * 9/2001 Miller ..... 52/405.1
2001/0032431 A1 * 10/2001 Grinhpun et al. ..... 52/309.12

* cited by examiner

*Primary Examiner* — Brian Glessner
*Assistant Examiner* — Joshua Ihezie
(74) *Attorney, Agent, or Firm* — J. David Nelson

(57) ABSTRACT

An improved dry stack insulated building block and block wall system, the block having a first and a second side wall, a central web interposed between the side walls, a pair of end transverse webs, and a pair of intermediate transverse webs. The side walls, central web, and transverse webs define a first, a second, and a third cell. A first cell core, second cell core, and a pair of third cell cores of insulative material are inserted in the respective cells. The cell cores have trapezoidal shaped ear members which matingly fit in notches in the transverse webs, the trapezoidal shaped ear members providing for the creation of a notch gap between the base of the ear members and the notch bottom of the respective notches, thereby accommodating crumbing in the notch bottom.

56 Claims, 5 Drawing Sheets

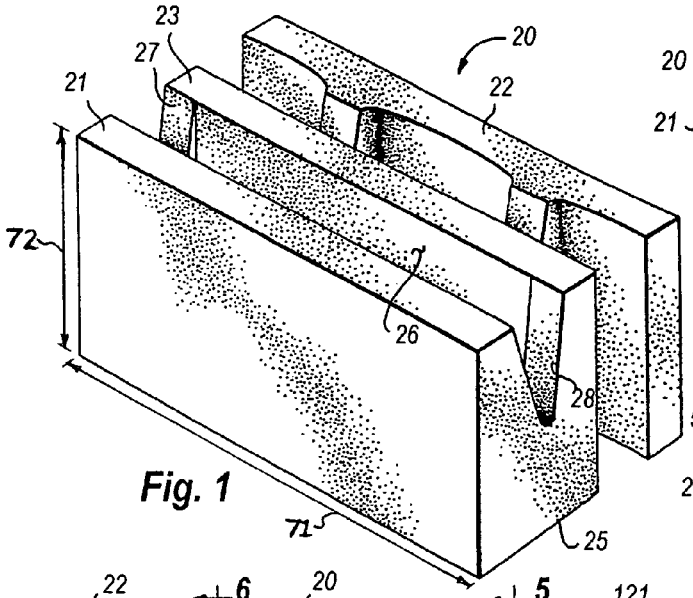
Fig. 1
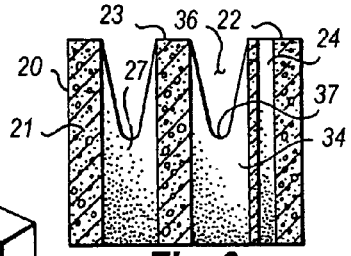
Fig. 6
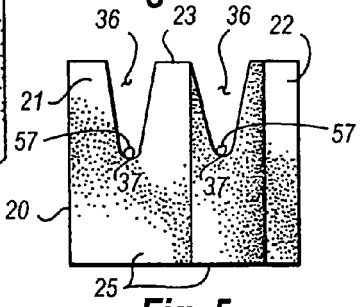
Fig. 5
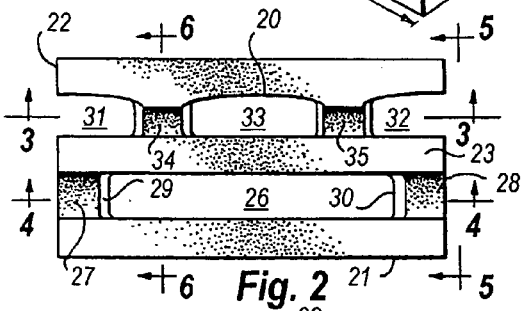
Fig. 2
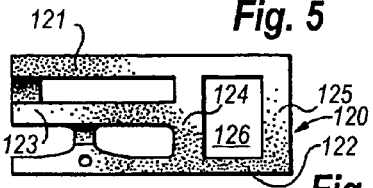
Fig. 15
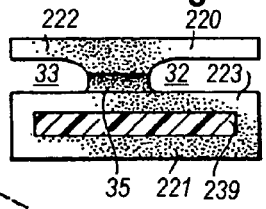
Fig.16
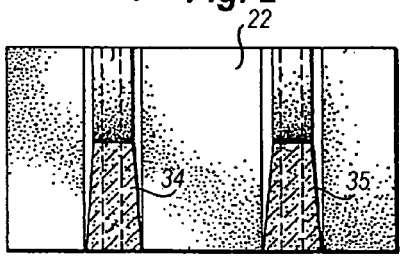
Fig. 3
Fig. 4
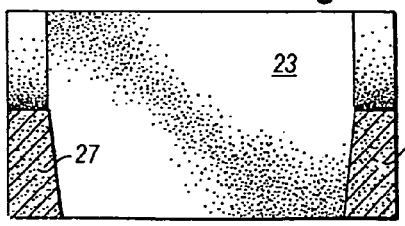
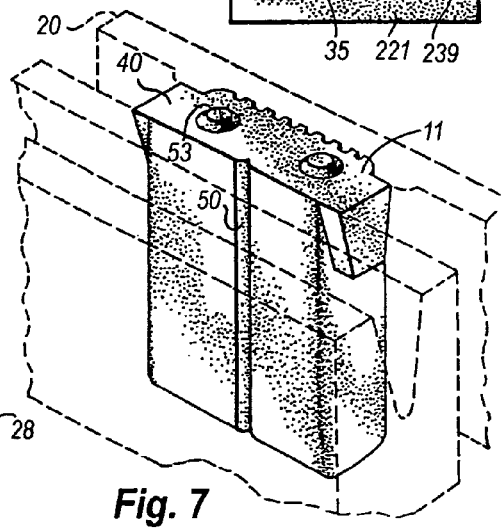
Fig. 7

DRY STACK INSULATED BUILDING BLOCKS

TECHNICAL FIELD OF THE INVENTION

The present invention relates to dry stack construction blocks, i.e., blocks that may be stacked in running courses to erect a free-standing wall without the use of mortar. More particularly, the present invention relates to dry stack construction blocks with insulation inserts.

BACKGROUND OF THE INVENTION

The use of masonry blocks in the construction industry has been widespread for many years. Masonry blocks are constructed of various materials, lightweight concrete being the most prevalent. Various designs of blocks have also been utilized, many attempting to minimize the weight of the block while preserving as much structural strength as possible. Common block designs incorporate exterior walls connected by webs of various designs, creating interior cores of air space. In addition to reducing the weight of the block, the air space provides for decreasing the overall thermal conductivity of the block. Insulation inserts are also used in the cores to further decrease the thermal conductivity of the blocks.

Historically, most masonry block wall construction has consisted of staggered block construction with mortar joints between blocks of each course and between successive courses of blocks. The mortar joints provide for leveling and maintaining uniform dimensions for each course of block despite variations in the dimensions of individual blocks.

Dry stack block construction, masonry block construction without the use of mortar between adjacent block, has not achieved widespread use to date. However, some of the principal advantages of dry stack block, in comparison to mortared block construction, are the increased speed of construction and the decreased labor costs. A lesser skill level is required for workmen that merely stack block along a desired wall alignment. Further, hod tenders are not needed. As with a common mortared block wall, the primary structural strength of the dry stack wall is derived from the horizontal bond beams and vertical grout columns, each with one or more reinforcing bars ("rebar") grouted in place.

U.S. Pat. No. 4,748,782 (Johnson '782) and U.S. Pat. No. 4,769,964 (Johnson '964) to Johnson disclose a dry stack block and methods for using a dry stack block to construct a wall. The present inventors' experience with the block of Johnson '964 and Johnson '782 has led them to conclude that the block is neither self-aligning nor self-leveling. The inherent difficulty in manufacturing the dry stack block and the cell cores disclosed by Johnson '964 and Johnson '782 to precise dimensions, the variability, albeit lesser, in the dimensions of the cell cores, and the compressibility of the cell cores, albeit slight but variable depending on the density of the cell core, of the cell cores, provides for inadequate and inconsistent alignment and leveling of the block courses. Further the intended extension under Johnson '964 and Johnson '782 of the top of the cell core above the top of each block and each block course, purportedly to provide for horizontal alignment of the block of each course and for uniform vertical spacing between the block of adjacent courses, has been found by the present inventors to be ineffective. The experience of the present inventors has further led them to conclude that the transfer of vertical load from one course to another, during construction or thereafter, through the cell cores, is undesirable. The foregoing limitations of the block, the block wall, and the method of Johnson '964 and Johnson '782 appear to be due primarily to lack of dimensional uniformity of the block, and variations in the dimensions and density of the cell cores.

Another particular problem noted with the dry stack block of Johnson '964 and Johnson '782 is that crumbing inherently occurs in the block manufacturing process causing crumbing to be deposited in and cemented in the notch bottom ("crotch") of web notches in the block intended to receive the ears of the insulating, aligning, and leveling cell cores. This causes the ears of the cell cores to fit poorly in the corresponding block web notches, further inhibiting the intended aligning and leveling function of the cell cores.

It is an object of the present invention to provide a dry stack block cell core and dry stack block assembly that are practical to use for the construction of a block wall, reduce the required skill and cost of labor used to construct the wall, and provide for the construction of a block wall with enhanced thermal resistivity and good structural characteristics.

It is a further object of the present invention to provide a method for constructing a dry stack block wall for which the required skill and cost of labor used to construct the wall is reduced, and the thermal resistivity is enhanced.

It is a further object of the present invention to provide a dry stack block cell core, dry stack block assembly, dry stack block wall, and method for constructing a dry stack block which will address some of the deficiencies of the dry stack block of Johnson '964 and Johnson '782, and in particular with the cell core.

It is a further object of the present invention to provide a dry stack block cell core and dry stack block assembly which will improve the ability of the cell core to accommodate crumbing in the notch bottom of the block web notches.

It is a further object of the present invention to provide a dry stack block cell core and dry stack block assembly which will improve the ability of the cell core to accommodate variations in the dimensions of the dry stack block.

It is a further object of the present invention to provide a dry stack block cell core and dry stack block assembly which will improve the ability of the cell core to accommodate variations in the dimensions and density of the cell core.

It is a further object of the present invention to provide a dry stack block cell core, dry stack block assembly, dry stack block wall, and method for constructing a dry stack block which will provide for reducing and ameliorating the alignment and leveling problems of the block, the wall, and the method of Johnson '964 and Johnson '782.

It is a further object of the present invention to provide a dry stack block cell core, dry stack block assembly, dry stack block wall, and method for constructing a dry stack block wall providing for an improvement in the manner and method of accommodating rebar for the horizontal bond beams and the vertical grout columns.

SUMMARY OF THE INVENTION

A preferred embodiment of a dry stack construction block of the present invention comprises a first and a second side wall and a central web interposed between the first side wall and the second side wall. The blocks may be arranged in running courses in a symmetrical staggered stack configuration or may be stacked in other configurations that will be known to persons skilled in the art.

The first side wall, the central web, and the first and second end transverse webs define the longitudinal bounds of a first cell. The space between the central web and the second side wall can contain two open-ended third cells separated by a central second cell. Intermediate transverse webs, each having reduced height, are disposed at each end of the second cell and define the boundary between the second cell and each of the third cells.

First and second end transverse webs are disposed outwardly from first and second intermediate transverse webs respectively so that a single transverse plane does not pass between the end transverse webs and the intermediate transverse webs. The height of transverse webs is deliberately reduced and typically stands slightly more than one-half the height of block. The transverse webs are especially designed to enable the block to have the strength necessary to meet the various building codes while the reduced height of the webs reduces the volume of the thermal conduction path and hence the thermal transfer between the first side wall and the second side wall. Each transverse web is provided with a V- or U-shaped notch or hyper-extended draw which converges to a curvilinear notch bottom.

A first cell core is disposed within the first cell while a second cell core is disposed in the second cell and a third cell core is disposed in each of the third cells. The second cell cores and the third cell cores may be identical in size and shape, thereby limiting the number of types of cell cores to two. In a preferred embodiment the cores will be formed of an insulating material such as, for example, a low-density foam such as expanded polystyrene, thereby reducing the rate of thermal conduction through the resultant block wall.

Each of the first cell cores, the second cell cores, and the third cell cores has an ear member attached to each end of the body portion of the cell core. For preferred embodiments, the ear members will be integrally molded with the body portion of the cell cores, but other embodiments may provide for the ear members to be affixed to the body portion of the cell cores in some other manner which will be known to persons skilled in the art.

Each of the cell cores may be fluted on the surfaces that contact the block surfaces in the respective cells. The fluting may provide an interlocking relationship with the adjacent surface of the receiving cell to create a "custom fit" of the core with the receiving cell. Alternatively the surfaces of the cores may be smooth.

For the present invention, each ear member has a generally trapezoidal shape, i.e. a generally trapezoidal cross section, having its widest dimension in substantially co-planar relationship with the core top surface and its narrowest dimension at the ear base. The term "trapezoidal shaped" when used to describe the ear members, shall be defined to include having a generally trapezoidal cross section and a generally trapezoidal shape as observed from an end view. The ear member extends, when the cell core is inserted in a block, downwardly for a distance not reaching the notch bottom of the U- or V-shaped notch defined in each of transverse webs. When a cell core is inserted in a block, a notch gap is formed between the ear member base and the notch bottom of the corresponding notch. Because the ear member base does not mate with the notch bottom, the typical compressibility, albeit limited, of the cell core material, allows the cell core to be urged into a proper position in the cell, thereby providing that the core top surface is at or below the top of the block when installed. The cell core is dimensioned so that the cell core will not extend beyond the block top surface or block bottom surface when installed, except for spurs on embodiments having spurs as described herein. Unlike the cell core of Johnson '782', the cell core of the present invention is not intended to provide for leveling of the blocks in each course or for the creation of a gap between the blocks of successive courses. The trapezoidal shaped ear of the present invention provides the benefit of a tight fit between the ear and the notch of the transverse web while providing the further benefit of accommodating, by the notch gap of unoccupied space between the ear base and the notch bottom, an accumulation of crumbing in the notch bottom of the transverse web which inherently accumulates during the manufacturing process for the block.

Despite attempts to manufacture blocks with uniform dimensions, variations in the block dimension, including the dimension between the notch bottom in the U- or V-shaped notch and the bottom surface of the block, are inevitable. Accordingly, since the present invention provides that when the ear members are seated in their corresponding U- or V-shaped notch, the distance from the ear base to the notch bottom can be adjusted during the insertion of the cell core to provide for an appropriate fit of the cell core, the top of the cell core being at or below the block top surface and the bottom of the cell core being at or above the block bottom surface.

As previously mentioned, one of the more imprecise dimensions of a molded construction block is the height of the block. The height of the block varies with the amount of material impressed into the mold from which the block is manufactured. Molded construction block therefore has a tendency to run slightly undersized from a standard height dimension, for example, eight inches. Further, this inaccuracy generally cannot be effectively compensated for by the ability to maintain more uniform control of the height of the cores and the dimensions of the ear members integrally formed thereupon. Thus, a fixed and precise height dimension generally cannot be established for the combination of a block and one or more cores when inserted therein, even with trapezoidal shaped ear members firmly seated within the corresponding U- or V-shaped notch provided in each transverse web. The cell cores are dimensioned to be inserted into the cells while leaving an unoccupied volume of space as a notch gap between the ear base of the cell core trapezoidal shaped ear member and the notch bottom.

The cell cores are each disposed in the receiving cell and trapezoidal shaped first ear members are firmly seated in the U- or V-shaped notch defined in the corresponding transverse web while still leaving a notch gap. Third cell cores are disposed into each of the open-ended cells as well as extending into intimate abutting contact with a portion of an adjacent second cell core. When a third cell core is disposed in one of the open-ended cells, approximately one-half of the third cell core will extend beyond the bounds of the associated cell into the open-ended cell of the concrete block adjacent thereto and in registry therewith in a block course.

By extending selected third cell cores beyond the longitudinal bounds of the principal block into the adjacent block, a block gap is preferably produced between the facing ends of adjacent blocks which serves to provide that the molded cores will help compensate for the longitudinal dimension (length) variations of the block. For a preferred embodiment, the block gap between adjacent concrete blocks will be approximately one-eighth of an inch when the blocks are set in running courses to erect a standing wall.

Since dry stacked blocks employed in the erection of a standing wall are preferably coated, after erection of the wall, with a surface bond of cementious material, the block gap between blocks, as described above, will readily accept the surface bond of cementious material to provide a strong gapless interlock and enhance the shear strength and lateral strength of the standing wall. The surface bond can also provide the additional benefits of obscuring vertical, longitudinal and lateral variations in the alignment of the blocks in running courses and variations between adjacent courses.

Cores may be optionally provided with a pair of nodes or spurs on the top thereof and complementary recesses on the bottom thereof, which coact with one another to create an interlock when a structure is assembled. When blocks with cores inserted therein are laid in running courses, each spur will matingly interlock with a complementary recess. The interlocking of the several spurs with their corresponding recesses reduces the misalignment or skewing of individual blocks. Further, the interlocking of the spurs and recesses complements the stabilizing action of cores which extends from the open cells in one block into the contiguous open cell in the block adjacent thereto.

When local building codes or structural design requirements dictate that there be continuous vertical grout columns spaced along the running length of the wall, such a column is readily created by selectively omitting second or third cell cores in a vertically aligned series of short cells to create a continuous vertical void in the standing wall so erected. Thereafter one or more vertically extending reinforcing bars can be readily placed within the void and grouted in place to form a grout column. Likewise horizontal bond beams can be readily formed by omitting all second and third cell cores from a given running course of block, laying one or more horizontally-extending reinforcing bars in the curved notch bottom of the several intermediate transverse webs and thereafter filling the void remaining with grout. Preferably the first cell cores are also omitted from the same running course and one or more reinforcing bars are laid in the curved notch bottom of the several end transverse webs so as to extend across several first cells and thereafter filling the void remaining with grout. Additional horizontal bars can also be installed in a bond beam by running them through the second and third cells of a running course and through the first cells of a running course after partial filling of the cells of the course with grout.

Despite the interlocking of the cell cores and substantial uniformity in the manufacturing of the cell cores, depending on the level of uniformity in the manufacture of the blocks and on the skill and care exercised in the building of the dry stack block wall, the dry stack block wall system may display substantial variations in vertical, longitudinal and lateral alignment. The vertical and longitudinal alignment irregularities can be compensated for at least partially as the dry stack block wall is being built through the selective use of block shims for individual blocks or the use of mortar joints between selected blocks or courses. Leveling and finishing of the wall at a design height or design top of wall elevation, can be accomplished by a leveling cap.

In another embodiment of the wall system, an alternative block with no central web and an alternative block configuration may be used. The first and second side walls are connected by two transverse block webs. First and second end cells are formed on opposite sides of the central cell in the center of each of the blocks. When these alternative blocks are placed end-to-end, the void formed between the transverse webs of adjacent blocks can be identical in shape and configuration to the central cell formed through the center of each of the blocks. This permits the construction in a running bond configuration when the insulation cores are placed in either of these locations. The cores can be formed with ribs or fluting extending vertically, along the sides of the inserts. Each of the insulating cores has a pair of downwardly extending trapezoidal shaped projections on opposite ends. These projections are formed to fit within the V- or U-shaped openings in the transverse webs. As with the preferred embodiment of the block described above, this alternative block provides, through the omission of cell cores, for the insertion and grouting of vertical rebar for grout cells and for the insertion and grouting of horizontal rebar for bond beams.

BRIEF DESCRIPTION OF THE DRAWINGS

FIG. 1 is a perspective view of a dry stack construction block of the present invention.

FIG. 2 is a plan view of the block shown in FIG. 1.

FIG. 3 is a cross-sectional view taken along line 3-3 of FIG. 2.

FIG. 4 is a cross-sectional view taken along line 4-4 of FIG. 2.

FIG. 5 is an elevation view taken along line 5-5 of FIG. 2.

FIG. 6 is a cross-section view taken along line 6-6 of FIG. 2.

FIG. 7 is a perspective view of a cell core of the present invention showing a block (in phantom) with the cell core installed.

FIG. 15 is a plan view of an embodiment of a corner block of the present invention.

FIG. 16 is a plan view of an embodiment of a half-block of the present invention.

DETAILED DESCRIPTION OF THE INVENTION

While the terminology used in this application is standard within the art, the following definitions of certain terms are provided to assure clarity. Units, prefixes, and symbols may be denoted in their SI accepted form. Numeric ranges recited herein are inclusive of the numbers defining the range and include and are supportive of each integer within the defined range. Unless otherwise noted, the terms "a" or "an" are to be construed as meaning "at least one of." The section headings used herein are for organizational purposes only and are not to be construed as limiting the subject matter described. All documents, or portions of documents, cited in this application, including but not limited to patents, patent applications, articles, books, and treatises, are hereby expressly incorporated by reference in their entirety for any purpose.

Figure 14:
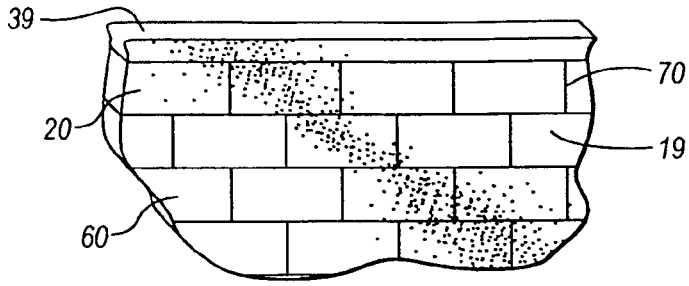
FIG. 14 is an elevation view of a dry stack wall system of the present invention with a leveling cap poured on top of the top course of block.
Figure 26:
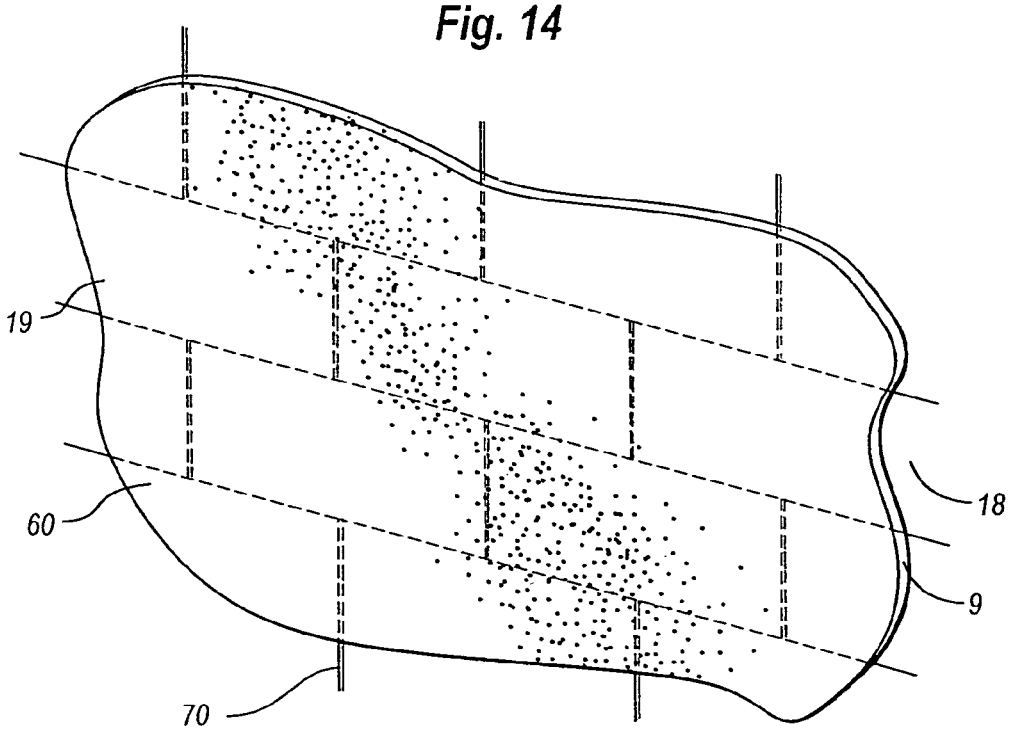
FIG. 26 is a perspective view of a portion of a wall system of the present invention with surface bond.
Figure 27:
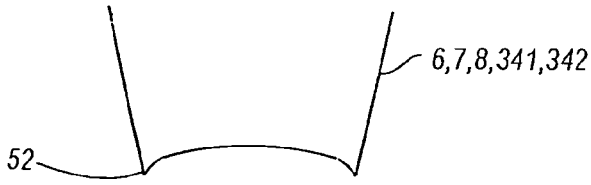
FIG. 27 is a vertical cross section detail of an alternative cell core ear base.

Referring first to FIGS. 1-6, a preferred embodiment of a dry stack construction block 20 is shown which comprises a first and a second side wall, 21 and 22 respectively, and a central web 23 interposed between the first side wall and the second side wall. The walls and central web may be generally rectangular and generally parallel to one another and having generally the same block wall axial length 71 and wall height 72. For purposes of this application, the term "rectangular" shall be deemed to mean substantially rectangular, the term "parallel" shall be deemed to mean substantially parallel, and the term "perpendicular" shall be deemed to mean substantially perpendicular. Blocks 20 may be arranged in running courses 19 in a symmetrical staggered stack configuration 60 as shown in FIG. 14 and FIG. 27 or may be stacked in other configurations that will be known to persons skilled in the art. One advantage of the dry stack wall system 18 of the present invention is that it does not depend for its strength on the symmetrical staggered configuration utilized for a common masonry block wall.

First side wall 21, central web 23, and first and second end transverse webs 27 and 28, respectively, define the longitudinal bounds of first cell 26. As is seen in FIG. 2, the interior surfaces 29, 30 of transverse webs 27, 28, respectively, are tapered for interfacing with first cell core 11 as described below. The mold used to cast block 20 will have a complementary shape for the mold employed to form the first cell core 11, the mold for the first cell core being dimensioned to be complementary with the interior surface of wall 21, the facing surface of central web 23 and surfaces 29, 30 of transverse webs 27, 28. The first cell core, however, as more fully explained below will not follow the precise contours of transverse webs 27 and 28.

The space between central web 23 and second side wall 22 can contain two open-ended third cells 31 and 32 separated by a central second cell 33. The walls of the individual cells are created by forming the inwardly facing surfaces of central web 23 and second side wall 22. Intermediate transverse webs 34 and 35, each having reduced height, are disposed at each end of the second cell 33 and define the boundary between the second cell 33 and third cells 31 and 32, respectively.

As shown in FIGS. 2 and 3, first and second end transverse webs 27 and 28 are disposed outwardly from first and second intermediate transverse webs 34 and 35 respectively so that a single transverse plane does not pass between web 27 and web 34 or between web 28 and web 35. The height of transverse webs 27, 28, 34 and 35 is deliberately reduced and typically, stand slightly more than one-half the height of block 20. Webs 27, 28, 34 and 35 are especially designed to enable block 20 to have the strength necessary to meet the various building codes while the reduced height of the webs reduces the volume of the thermal conduction path and hence the thermal transfer between walls 21 and 22. Each web 27, 28, 34 and 35 is provided with a V- or U-shaped notch or hyper-extended draw 36 which converges to a curvilinear notch bottom 37, the interface with corresponding cell cores 26, 31, 32 and 33 of which shall hereafter be described in detail. Nonetheless, it should be noted that the V-shaped draw 36 enables the manufacturer to obtain proper compression during the molding process with stronger compaction and avoids the fracture points which inevitably result if the draw terminated in a square bottom.

Figure 8:
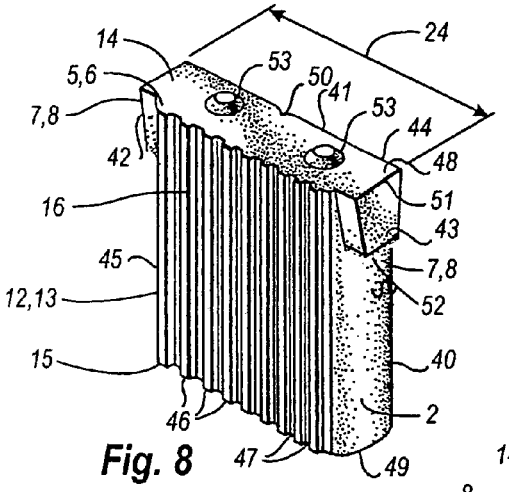
FIG. 8 is a perspective view of a preferred embodiment of a second cell core or third cell core of the present invention.
Figure 9:
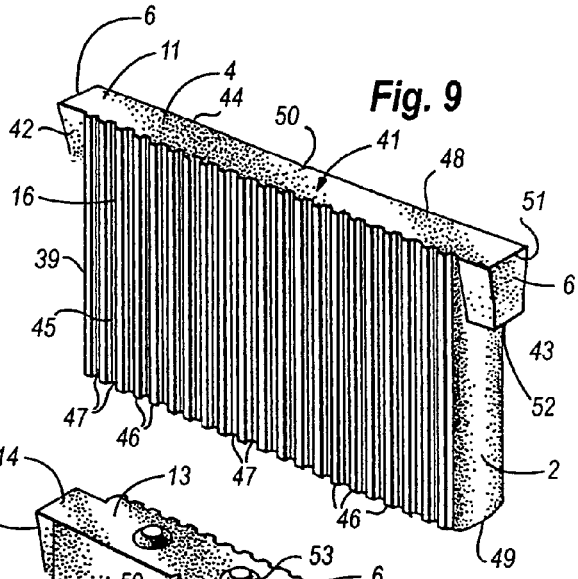
FIG. 9 is a perspective view of a preferred embodiment of a first cell core of the present invention.
Figure 10:
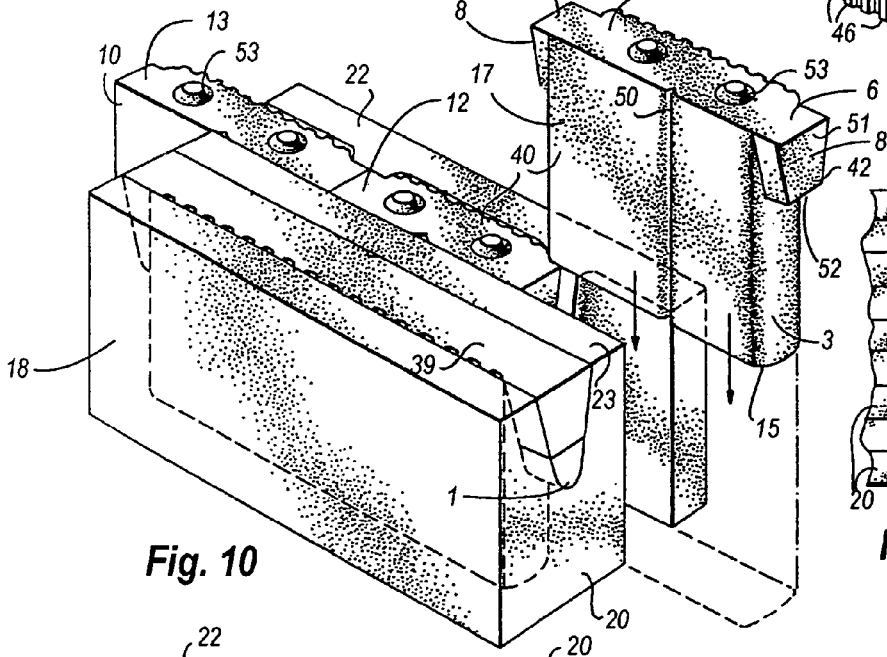
FIG. 10 is a perspective view of a preferred embodiment of a block assembly of the present invention with a first cell core, second cell core, and a third cell core installed in the block, and a further third cell core positioned for installation.

Having thus described a construction block 20 whose interior dimensions can be effectively replicated throughout long manufacturing runs, refer now to FIGS. 8, 9 and 10 wherein the cell cores may be installed into the construction blocks 20.

As shown in FIG. 10, a first cell core 11 is disposed within first cell 26 in near shape-conforming relationship thereto while a second cell core 12 is disposed in near shape-conforming relationship to second cell 31, and a third cell core 13 is disposed in near shape-conforming relationship to third cells 32 and 33. For the embodiment shown, the second cell cores and the third cell cores are identical in size and shape, thereby limiting the number of types of cell cores to two. However, other embodiments may provide for the second cell cores and the third cell cores to be of different size or shape, or both. While cell cores 11, 12, 13 may be molded of any material which allows substantial control of its dimensional characteristics, in a preferred embodiment, cores 11, 12, 13 will be formed of an insulating material such as, for example, a low-density foam such as expanded polystyrene or the like whereupon the rate of thermal conduction through the resultant block wall is substantially reduced.

Referring to FIGS. 8, 9, and 10, the core axial length 24 of cell cores 11, 12, 13 may vary, but the principal construction of the cell cores will be preferably the same, that is, each will comprise a top surface 14, a bottom surface 15, a first face surface 16, a second face surface 17, a first end surface 2, and a second end surface 3. Tablet shaped body portions, namely tablet shaped first body portion 4, tablet shaped second body portion 5, and tablet shaped third body portion 6, of the first cell core 11, second cell core 12, and third cell core 13 respectively, are interposed between and formed by the respective top surfaces, bottom surfaces, first face surfaces, second face surfaces, first end surfaces, and second end surfaces. The first cell core has a pair of opposing first ear members, one first ear member 6, being integral with the first end surface of the first cell core and an opposing first ear member 6 being integral with the second end surface of the first cell core. Similarly, the second cell core has a pair of opposing second ear members, one second ear member 7 being integral with the first end surface of the second cell core and an opposing second ear member 7 being integral with the second end surface of the second cell core. Likewise, the third cell core has a pair of opposing third ear members, one third ear member 8 being integral with the first end surface of the third cell core and an opposing third ear member 6 being integral with the second end surface of the third cell core. For preferred embodiments, the ear members will be integrally molded with the body portion of the cell cores, but other embodiments may provide for the ear members to be integral with the body portion by being affixed to the body portion of the cell core in a manner which will be known to persons skilled in the art.

Hence, respective pairs of opposing first ear members 6, second ear members 7, and third ear members 8, are integrally molded with or otherwise integrally affixed to the first end surface and the second end surface respectively of the respective first, second and third cell cores. For the preferred embodiment shown, the axial length of first cell core 11 is about one-half the axial length of the second cell cores 12 and the third cell cores 13 for reasons to be hereinafter described.

Referring to FIG. 8, for the second cell core 12 and the third cell cores 13 and to FIG. 9 for the first cell core 11, each of the cell cores comprise a body portion having an ear member disposed at each end. Body portions comprise a generally vertical, planar surface 44 and a bowed inwardly tapering surface 45. Surface 45 is provided with a plurality of spaced generally parallel vertically extending ridges 46 having a concave valley portion 47 operatively interposed between them and extending from the top surface 48 of body portion 41 to the bottom surface 49 thereof. The interaction of ridges 46 with their adjacent valleys 47 will herein be referred to as "fluting" which may provide an interlocking relationship with the adjacent surface of the receiving cell to create a "custom fit" " of the core with the receiving cell. Optionally, body portion 41 can be scored at its horizontal mid point, designated score line 50, which extends the full height of the core to facilitate dividing the core in half for use as described below.

In an alternative form, second cell core 12 and third cell cores 13 as shown in FIG. 7 and FIG. 10 omit the fluting so as to instead provide a planar surface. Similarly, first cell cores 11 may omit the fluting.

For the preferred embodiment shown, each ear member 6,7,8 is trapezoidal shaped, having its widest dimension 51 in substantially co-planar relationship with core top surface 48, the ear member extending, when the cell core is inserted in a block, downwardly to the ear base 52 for a distance not reaching notch bottom 37 of the U- or V-shaped notch 36 defined in each of transverse webs 27, 28, 34 and 35 of the block 20, thereby creating a notch gap 1. Because the ear member base does not mate with the notch bottom, the typical compressibility, albeit typically limited, of the cell core material, allows the cell core to be urged into a proper position in the cell, thereby providing that the core top surface 48 is at or below the block top surface when the core is installed. The cell core is dimensioned so that the cell core will not extend beyond the block top surface or block bottom surface when installed, except for spurs on embodiments having spurs as described herein. When a cell core is inserted in a block, a notch gap 1 between the ear base 52 of the ear member 6,7,8 and the notch bottom 37 of its corresponding notch 36. The cell core of the present invention is not intended to provide for leveling of the blocks in each course or for the creation of a block gap between the blocks of successive courses. The trapezoidal shaped ear of the present invention provides the benefit of a tight fit between the ear and the notch 36 of the transverse web while providing the further benefit of accommodating an accumulation of crumbing in the notch bottom 37 of the transverse web which inherently accumulates during the manufacturing process for the block.

Despite attempts to manufacture blocks with uniform dimensions, variations in the block dimensions, including the dimension between the notch bottom 37 in the U- or V-shaped notch and the block bottom surface 25, are inevitable. Accordingly, since the present invention provides that when the ear members are seated in their corresponding U- or V-shaped notch, the distance from the ear base to the notch bottom can be adjusted during the insertion of the cell core to provide for an appropriate fit of the cell core, the top of the cell core being at or below the block top surface and the bottom of the cell core being at or above the block bottom surface.

Figure 11:
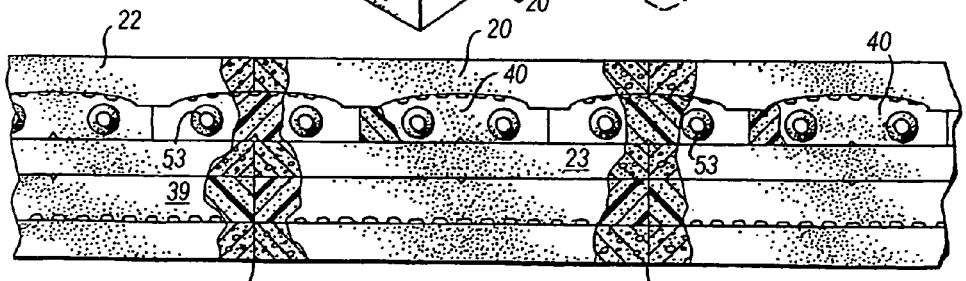
FIG. 11 is a plan view of three abutting blocks of a course of blocks having first, second, and third cell cores in place.

As shown in FIGS. 10 and 11, continuous central web 23 of each unique block 20 employed herewith enables both halves of block 20 to be insulated by the insertion of the appropriate cell core 11, 12 or 13 therein or only one-half to be insulated while the other half is filled with aggregate to enhance the strength of the wall and provide that wall with thermal flywheel when warranted or desired. Modifications for the inclusion of reinforcing bars, grout cells, bond beams, and electrical conduit or the application of a surface bond are described below.

As earlier described, each improved building block 20 has first and second side walls 21, 22 and a central web 23 operatively disposed between the side walls in spaced generally parallel relationship to side walls 21, 22. Central web 23 and first side wall 21 define core receiving cells 26 while central web 23 and second side wall 22 define cells 31, 32 and 33 during the molding of the blocks.

As previously mentioned, one of the more imprecise dimensions of a molded construction block is the height of the block. The height of the block varies with the amount of material impressed into the mold from which the block is manufactured. Molded construction block therefore has a tendency to run slightly undersized from a standard height dimension, for example, eight inches. The variations in the dimensions of the block generally cannot be effectively compensated for by the ability to maintain more uniform control of the height of cores 11, 12 and 13 and the dimension of ear members 6, 7, 8 integrally formed thereupon. Thus, a fixed and precise height dimension generally cannot be established for the combination of a block 20 and one or more cores 11, 12, 13 when inserted therein with trapezoidal shaped ear members 42 and 43 firmly seated within the corresponding U- or V-shaped notch 36 provided in each transverse web 27, 28, 34 and 35. However, the walls of the individual cells 26, 31, 32 and 33 in block 20 can be produced with interior dimensions of sufficient uniformity so that the more uniformly dimensioned cores 11, 12 and 13 will fit the cells with sufficient intimacy for leaving an unoccupied volume of space as a notch gap 1 between the ear base 52 of the cell core trapezoidal shaped ear member and the notch bottom 37, and providing for the top of the cell cores to be at or below the top of the block.

With reference to FIGS. 1, 2, 9 and 10, first cell core 11 is disposed in first cell 26 and extends axially whereupon trapezoidal shaped first ear members 6 are firmly seated in the U- or V-shaped notch 36 defined respectively in end transverse webs 27, 28 while still leaving a notch gap 1. As shown in FIG. 10, with reference likewise had to FIGS. 1, 2, 7 and 8, second cell core 12 is disposed intimately within cell 33 in near shape-conforming relationship to the walls of the cell. The fit of second cell core 12 in cell 33 is enhanced by the light "sanding" action on ridges 46 caused by the harder inner surface of the cell as trapezoidal shaped second ear members 7 are firmly seated in the U- or V-shaped notch 36 defined respectively in webs 34, 35. trapezoidal shaped ear members 7 of second cell core 12 occupy only one-half of the notch axial length 73 of the notches 36 in the contiguous webs 34, 35 in contrast to the corresponding first ear members 6 of the first cell core 11 each of which extend completely across the notches 36 defined in contiguous end transverse webs 27, 28. Third cell cores 13 are disposed into each of the open-ended cells 31, 32 in a near intimate shape-conforming engagement with the interior walls of its corresponding cell as well as extending into intimate abutting contact with a portion of an adjacent second cell core 12. When a third cell core 13 is disposed in one of the open-ended cells 31, 32, approximately one-half of the third cell core 13 will extend beyond the bounds of the associated cell 31, 32 into the open-ended cell 32, 31 of the concrete block 20 (see FIGS. 10 and 11) adjacent thereto and in registry therewith in a block course 19.

By extending selected third cell cores 13 beyond the longitudinal bounds of the principal block 20 into the adjacent block, a block gap 70 is preferably produced between the facing ends of adjacent blocks 20 which serves to provide that the cell cores will substantially control the horizontal dimensions of each course and thereby compensate for length variations in the block arising from the manufacture of the block. For a preferred embodiment, the block gap between adjacent concrete blocks will be approximately one-eighth of an inch when the blocks are set in running courses 19 to erect a standing wall. In one preferred embodiment, first cell core 11 will measure sixteen inches and second and third cell cores 12,13 will measure eight inches in length.

Since dry stacked blocks employed in the erection of a standing wall are preferably coated with a surface bond 9 of cementious material as shown in FIG. 27, the block gap 70 between blocks 20, as described above, will readily accept the surface bond of cementious material to provide a strong gapless interlock and enhance the shear strength and lateral strength of the standing wall. The surface bond can also provide the additional benefits of obscuring vertical, longitudinal and lateral variations in the alignment of the blocks in running courses 19 and variations between adjacent courses. Since dry stacked blocks, in certain preferred embodiments are not aligned and leveled through the use of mortared joints between blocks, the surface bond can be used to obscure such alignment and leveling variations to produce a finished wall that is uniform and plumb, in addition to being significantly strengthened against shear forces and against lateral forces, such as impact forces.

The intimate line contact maintained between adjacent first cell cores 11 and between adjacent second and third cell cores 12, 13 within a running course 19 of blocks 20 further enhances the thermal resistivity of a standing wall system 18 constructed from the blocks with cell cores installed, especially when the cores are made of an insulative material.

Referring now to FIGS. 7, 8, 11 and 12, cores may be optionally provided with a pair of nodes or spurs 53 on the top thereof and complementary recesses 54 on the bottom thereof, which, as will be explained, coact with one another to create an interlock when a structure is assembled using blocks 20 and cores 11, 12, 13 in accordance herewith. When blocks 20 with cores 11, 12, 13 inserted therein are laid in running courses, each spur 53 will matingly interlock with a complementary recess 54. The interlocking of the several spurs 53 with their corresponding recesses 54 reduces the misalignment or skewing of individual blocks. Further, the interlocking of the spurs 53 and recesses 54 complements the stabilizing action of cores which extends from the open cells 31 and 32 in one block into the contiguous open cell in the block adjacent thereto. In other embodiments, no nodes or spurs 53 are present.

Figure 12:
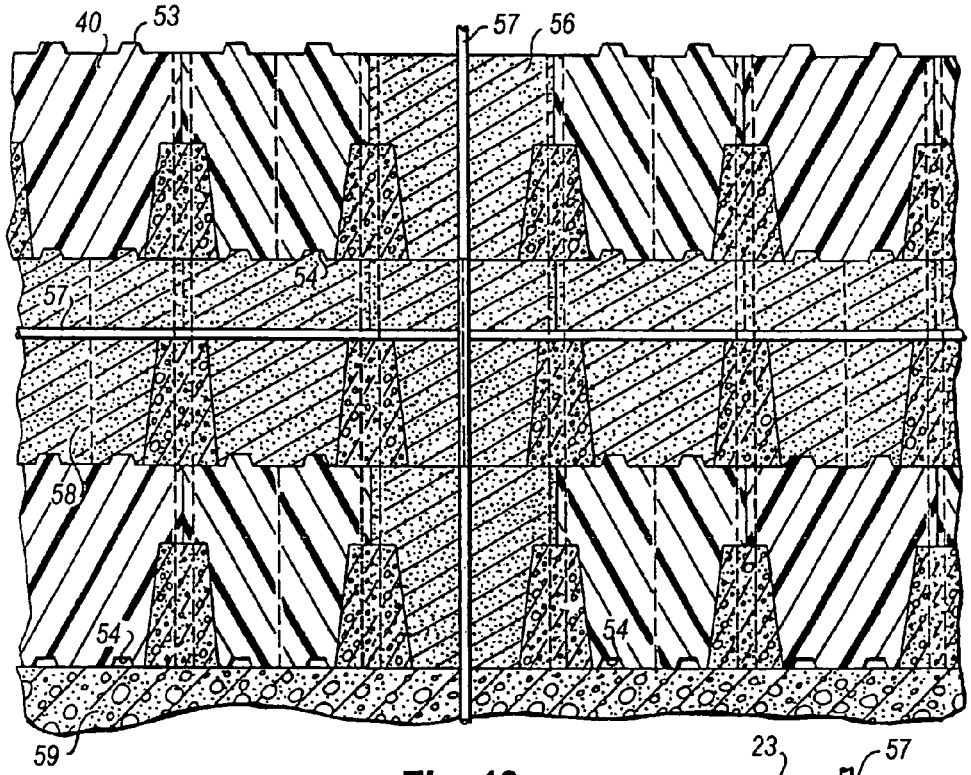
FIG. 12 is a vertical section of a portion of a wall showing two courses of block assemblies constructed to provide horizontal and vertical grout cells with reinforcing bars installed.

Sectional view of the standing wall shown in FIG. 12 also illustrates the ease with which the invention may be adapted to accommodate local building codes or the design of a structural engineer. Thus, when local building codes or structural design requirements dictate that there be continuous vertical grout columns spaced along the running length of the wall, for example at a spacing of four feet, such a column is readily created by selectively omitting second or third cell cores 12, 13 in a vertically aligned series of short cells 31, 32 or 33 to create a continuous vertical void in the standing wall so erected. Thereafter one or more vertically extending reinforcing bars 57 can be readily placed within the void thus created, when required to comply with local building code standards or with the structural design, and thereafter the void can be filled around the bars with grout to form a continuous vertical column of grout, shown as grout cell 56 in FIG. 12.

Many local building codes or structural design requirements also dictate that a bond beam be established, for example at a vertical spacing of four feet of height of the standing wall. Such a bond beam 58 (see FIGS. 12 and 13) is readily created when using the present invention and comprises a continuous horizontal beam of grout preferably formed by omitting all second and third cell cores 12, 13 from a given running course 19 of block, laying one or more horizontally-extending reinforcing bars 57 in the curved notch bottom 37 of the several intermediate transverse webs 34, 35 so as to extend across several second and third cells 31, 32, 33 and thereafter filling the void remaining with grout. Also, one or more additional horizontal reinforcing bars can be 'floated' on the grout after the second and third cells of the course are partially filled with grout. Preferably the first cell cores 11 are also omitted from the same running course and one or more reinforcing bars 57 are laid in the curved notch bottom 37 of the several end transverse webs 27, 28 so as to extend across several first cells 26 and thereafter filling the void remaining with grout. Again, one or more additional horizontal reinforcing bars can be 'floated' on the grout after the first cells of the course are partially filled with grout. By reinforcing and grouting both sides of the running course, the strength of the bond beam against side impact forces and other lateral forces from both sides of the standing wall, as well as from the vertical load, is increased. The cell cores which are disposed in the course of block 20 beneath bond beam 58 prevents the grout from migrating downwardly from the bond beam 58 into lower portions of the standing wall and eliminates the need for grout mesh. Bond beam 58 will set and lock itself to the spurs 53 protruding from cell cores disposed in the running course beneath the bond beam, thereby contributing further to the strength and stability of the wall created thereby.

Figure 13:
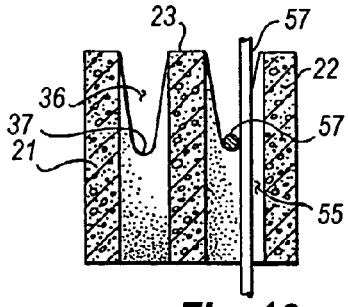
FIG. 13 is a vertical section view of a block showing vertical and horizontal rebar installed.

As shown in FIG. 13, rebar 57 can be readily disposed both vertically and horizontally within cells 31, 32 and 33. The reduced height of transverse webs 34, 35 and the curvilinear notch bottom 37 defined therein permits the precise placement of a horizontally extending reinforcing bar 57 within the confines of a course of blocks 20. Further, the juncture of each cell 31, 32, 33 with its correspondingly adjacent web 34, 35 creates a nook 55 into which a vertically extending rebar 57 can be nested without interference with the horizontal rebar when both are required or desired.

As previously indicated, FIG. 12 illustrates the interlocking action between spurs 53 and recesses 54 of adjacent cell cores. A further function of recesses 54 occurs at the junction between the fresh footing 59 and the first running course of block 20. Thus when block 20 is laid on the footing 59 and the cell cores are placed in their designated positions, the footing material 59 rises into recesses 54 and, upon setting, will further secure the first running course of block 20 to footing 59.

Despite the interlocking of the cell cores and substantial uniformity in the manufacturing of the cell cores, depending on the level of uniformity in the manufacture of the blocks and on the skill and care exercised in the building of the dry stack block wall, the dry stack block wall system may display substantial variations in vertical, longitudinal and lateral alignment. The vertical and longitudinal alignment irregularities can be compensated for at least partially as the dry stack block wall is being built through the use of block shims. These building code approved shims can be constructed of stainless steel, galvanized steel or other materials, and can be used to correct the vertical or longitudinal alignment of individual blocks. For instances where excessive vertical or longitudinal alignment irregularities occur, mortar joints between block or courses of block can be used on a selective basis. Leveling and finishing of the wall at a design height or design top of wall elevation, can be accomplished by a leveling cap 39 as shown in FIG. 14. The leveling cap is preferably constructed of fine aggregate concrete, grout or other cementious material and is finished at the desired wall height or top of wall elevation. The use of a leveling cap permits the expedited assembly of the wall by the placement of the dry stacked block and the correction of accumulated variation in the elevation of the top of block courses by placement of the leveling cap, block shims being used as desired as the block is being stacked.

Although preferred embodiments of the wall system of the present invention, do not utilize mortar joints between blocks, mortar joints can be used between adjacent blocks of a running course or between successive running courses to assist in alignment or leveling of the courses of block. For example, mortar joints can be used between successive courses at a pre-determined or field determined spacing to control the leveling of the courses within a minimum variation, thereby reducing the amount of correction that is required from the leveling cap 39 as shown in FIG. 14.

Figure 17:
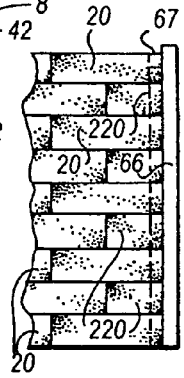
FIG. 17 is an elevation view of an embodiment of a window/door opening installation for the wall system of the present invention.

Another aspect of this disclosure is illustrated in FIGS. 15, 16 and 17 and deals with the easy and convenient manner whereby the present invention is readily adapted to finish corners (see: FIG. 15) and to frame the openings provided for windows and doors (see: FIGS. 16 and 17).

Referring to FIG. 15, each corner block 120 comprises a first and a second side wall 121, 122 having a central web 123 disposed between the first and second side walls and extending approximately one-half the corner block wall axial length 74 of the first and second side walls to a transverse wall 124 extending between walls 121, 122 and coacting with the side walls smooth end wall 125 to define a full size grout cell 126.

The half block 220 shown in FIG. 16 is simply one-half of a block 20 (see: FIGS. 1 and 2) and comprises a first and second side wall 221, 222, respectively, having a central web 223 operatively interposed between the first and second side wall. Disposed in half block first cell 226 which is interposed between side wall 222 and central web 223 is a half block first cell core 239, which may be a first cell core 11 (as shown in FIG. 9) after it has been cut to conform to cell 226 thereof. Alternatively, the half block first cell core 239 can be separately molded. The second and third cell cores 12, 13 may be molded with a cell core score 50 and can readily and uniformly be broken for use in the half blocks 220 when required.

Referring now to FIG. 17, a typical arrangement which is especially useful for expansion joints or in framing windows and doors using the system of the present invention is shown. Vertical member 66 represents the jamb of the frame of a door or window or fireplace but which can also be the location of an expansion joint. The structure as shown comprises an arrangement involving a plurality of full size blocks 20 mounted in staggered interlocking relationship to each other in the manner already described with a plurality of half blocks 220 interposed between the full size blocks in alternating courses to create a common planar surface having a vertically extending slot 67 therein to receive a support board (not shown) for abutting and supporting member 66. Slot 67 is created by the vertical alignment of the several compartments 32 with each other.

Figure 18:
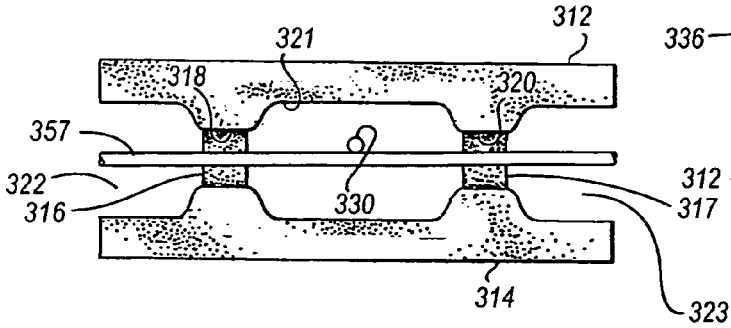
FIG. 18 is a plan view of an alternative embodiment of a dry stack block of the present invention having a central cell and opposing end cells.

In another embodiment of the wall system, an alternative block and alternative block configuration may be used. Referring now to FIG. 18, an alternative block 310 with no central web is shown. The block 310 has first and second side walls 312 and 314, respectively. When this block is incorporated with other blocks in a wall system, the first and second side walls, constitute the vertical inner and outer surfaces of the standing wall. Blocks may be dimensioned in width, height, and length as desired. However, this alternative block can be used to provide a block with a narrower width than the preferred block 20 with a central web.

Figure 19:
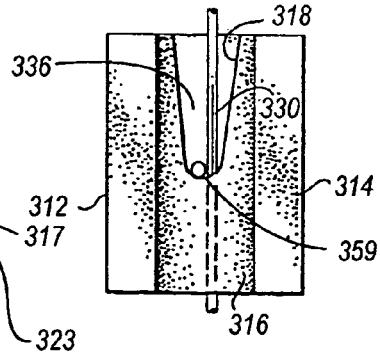
FIG. 19 is an end elevation view of the block of FIG. 18.

The first and second side walls 312 and 314 are connected by two transverse block webs 316 and 317, as shown in FIGS. 18 and 19. This causes the block 310 to appear as two interconnected "H" shapes, linearly aligned with one another when the block 310 is viewed from the top FIG. 18. The upper surfaces of the webs 316 and 317 are formed as a V- or U-shape, extending downwardly from the top of the block 310. This shape is seen most clearly in the end view of FIG. 19, which shows web 316. Web 317 can be identical in configuration, and may be aligned parallel with web 316.

Referring also to FIGS. 21-24 and FIG. 25, each of the V- or U-shaped web notches 336 of the webs 316 and 317 may accept a cell core 340, placed in the blocks prior to or during the construction of the walls.

Figure 20:
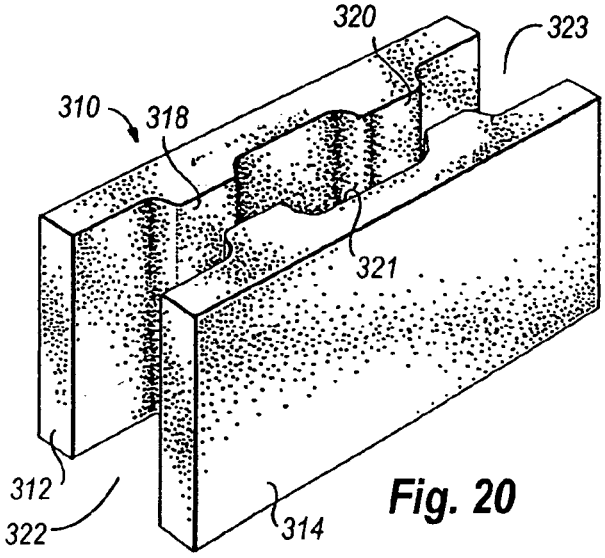
FIG. 20 is a perspective view of the block of FIG. 18.
Figure 21:
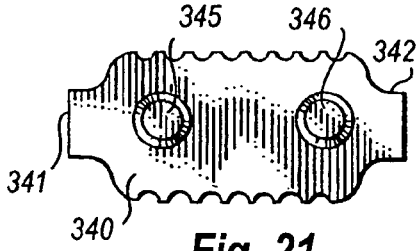
FIG. 21 is a plan view of an embodiment of a cell core used for the central cell and end cells of the block of FIGS. 18, 19 and 20.
Figure 22:
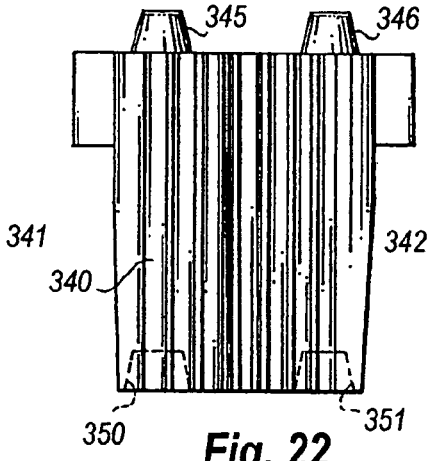
FIG. 22 is a side view of the insert of FIG. 21.
Figure 24:
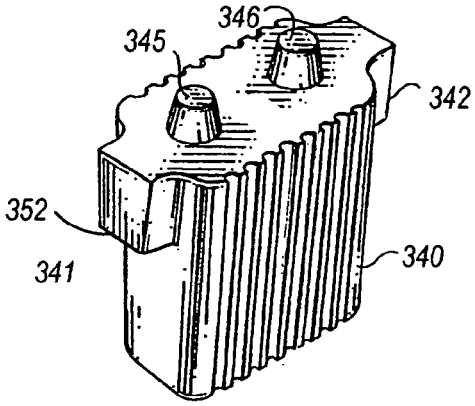
FIG. 24 is a perspective view of the insert shown in FIGS. 21, 22 and 23.
Figure 23:
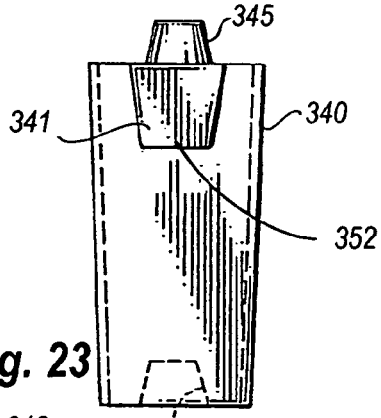
FIG. 23 is an end view of the insert of FIG. 21.

As seen in FIGS. 18 and 20, the inner surfaces of the outer face walls 312 and 314 can be thickened in the areas 318 and 320, where they are connected to the cross webs 316 and 317. This creates reinforcement columns in the wall system constructed using this embodiment of blocks, and provides for increased unit compressive strength.

Figure 25:
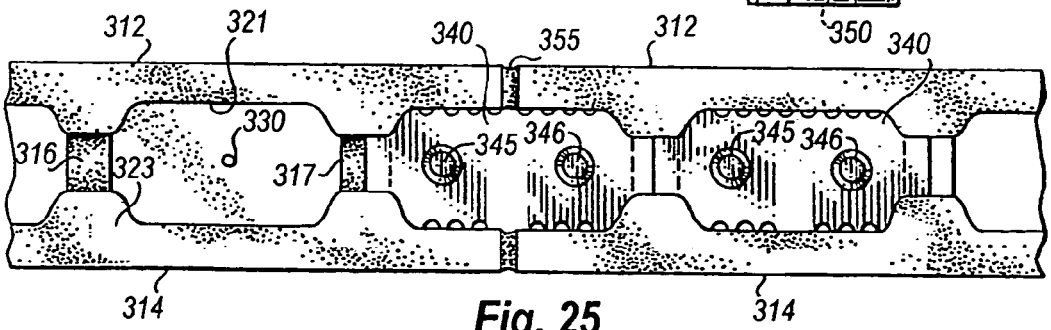
FIG. 25 is a plan view of three abutting blocks of a course of blocks utilizing the alternative block of FIGS. 18, 19 and 20 with cell cores and vertical reinforcing bar installed.

First and second end cells 322 and 323 are formed on opposite sides of the central cell 321 in the center of each of the blocks 310, as seen in FIGS. 18 and 20. These end cells are centered along the longitudinal axis of the wall formed by the outer faces 312 and 314. When blocks 310, of the type shown in FIGS. 18, 19 and 20, are placed end-to-end, the void formed between the transverse webs of adjacent blocks (allowing for standard thickness of mortar 355 if dry stack construction is not used) which includes the combined space of end cells 322, 323 of the adjacent blocks, can be identical in shape and configuration to the central cell 321 formed through the center of each of the blocks. This permits the construction, in a running bond configuration, as illustrated in FIG. 25 when the insulation cell cores are placed in either of these locations.

To provide improved thermal insulation qualities for a wall constructed of the alternative embodiment blocks 310, insulation cores 340 (FIGS. 21 to 24) are inserted into the central cell 321 formed in the center of each of the blocks between the cross webs 316 and 317. The cell cores 340 also are inserted in the voids formed between adjacent blocks by the first and second end cells when they are placed end-to-end. As indicated above, the voids between two adjacent blocks can be identical in size and shape to the central cell 321, so that only one size of insulation core 340 is required. The cell cores 340 may be formed with ribs or fluting extending vertically, along the sides of the cell cores. This provides passage for moisture migration vertically in the assembled wall, when the units are placed in a "running bond" allowing each cell core 340 to align with all of the other insulation cell cores in the wall vertically.

The cell cores 340 can be manufactured of a low density foam insulation, such as polystyrene or the like. Insulation foam cores can be used to fill the voids 321, and the voids between adjacent blocks, as described above. These insulation cores enhance the insulation qualities of the blocks 310 used in the wall to significantly decrease thermal conduction from one of the wall faces 312 or 314 to the other.

Each of the insulating cell cores 340 has a pair of opposing, downwardly extending trapezoidal shaped ear members 341 and 342, one on each end. These projections are formed to fit within the V- shaped or U-shaped notches in the transverse webs 316 and 317, while leaving a notch gap between the ear base 352 and the notch bottom 359. The notch gap for this embodiment is substantially illustrated by the notch gap 1 shown in FIG. 10.

The cell cores 340 may also have a pair of spurs 345 and 346 located in its top, midway between the center and the outer edge of the corresponding ear members 341 and 342. Similarly shaped recesses 350 and 351 can be located in the bottoms of each of the cell cores 340. The recesses 350 and 351 receive the projections 345 and 346 of an insulating cell core 340 located in a lower block 310. The projections 345 and 346 and recesses 350 and 351 provide some assistance in aligning the blocks 310, in which the insulating cell cores 340 are placed, to facilitate the construction of the wall in which they are used. Thus, the projections 345 and 346 and recesses 350 and 351 permit interlock between the various insulating cell cores when they are placed atop one another as the blocks 310 are assembled to create a wall.

For walls constructed with this alternative block, local building codes may also require, as described above for preferred embodiments, vertical grout columns with structural reinforcement to be placed at regularly spaced intervals along the length of the wall. Typically, these intervals may be approximately every four feet. As with a conventional concrete block wall, these grout columns are constructed by placing reinforcing bar within vertically aligned open and un-insulated cells through all of the blocks in this position, such that voids align to form a continuous vertical void. After the reinforcing bar 330 is inserted into such voids, grout is poured into the voids to establish the required reinforced grout column. Such a construction may be employed with the blocks shown in FIGS. 18 through 20. It is obvious that where such a grout column is formed, however, no insulation cell cores 340 may be used, so that the thermal insulating characteristics of the wall are impaired at the location of each of such grout columns. Similarly, horizontal bond beams are constructed in a running course 19 by omission of all of the cell cores 340 in the running course, extending one or more horizontal reinforcing bars 357 through the blocks of the running course positioned at the notch bottom 359 of the several transverse webs, and filling the voids around the rebar in each block of the running course with grout.

Figure 28:
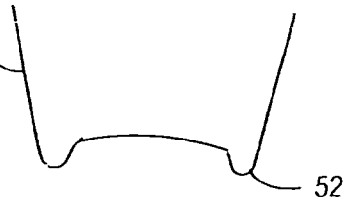
FIG. 28 is a vertical cross section detail of an alternative cell core ear base.

Referring to FIGS. 27 and 28, alternative embodiments of the trapezoidal shaped ear member ear base 52, that can be used for the first, second or third cell cores 11, 12, 13 or for the alternative block cell core 340, are shown. The ear base 52, 352 of FIG. 27 is concave. The ear base of FIG. 28 has a w-shaped cross-section. These two variations may offer increased compressibility of the base as the base is inserted in a notch. Other variations of the trapezoidal shaped ear member ear base may be used which will provide the desired notch gap 1 and provide for the top of cell core to be at or below the top of the block when the cell core is inserted in a block.

Preferred and alternative methods of using the preferred and alternative embodiments of the dry stack insulated block and the wall system of the present invention, for the construction of standing walls and structures constructed from the standing walls, are described in or will be apparent from the foregoing description, to persons skilled in the art. However, for clarification, a summary description of preferred methods of using the block and wall system is presented below.

A construction block having one or more novel cell cores, each of the cell cores featuring a pair of trapezoidal shaped ear members, is used for the preferred method of the present invention. The shape of the cell cores and the integral ear members may be obtained from molds. Insertable cell cores with substantially uniform dimensions may fit intimately within such cells and may come into intimate contact with like cell cores in adjacent blocks in a running course of blocks, and may further come into intimate contact with similar cells in adjacent blocks in adjacent courses. The intimate contact of the insertable cell cores permit the formation of open joint gaps between blocks of running courses, which open gaps may be converted to closed gaps by coating the wall erected with the blocks with a surface bond of cementious material.

The foregoing blocks and cores are readily transformed into a dry stacked structure by providing a base surface. The base surface may be leveled. A plurality of hollow cell blocks are placed end-to-end on a first row forming a course. The blocks may be of a pre-selected length, width, and height, with first and second side walls and a central web. The central web may be operatively interposed between the first and second side walls. The first and second side walls present first and second planar surfaces to define first, second, and third cells between the first and second planar surfaces.

The first core receiving cell may have first and second end transverse webs disposed transversely across from the first and second planar surfaces at each end of the planar surfaces. The first and second end transverse webs may be spaced parallel to each other. The second cell may have first and second intermediate transverse webs disposed transversely across in parallel relationship to each other at intermediate ends thereof. The intermediate transverse webs define a second cell which is interposed between the first and second intermediate transverse webs and also define a pair of open ended third cells adjacent to the intermediate transverse webs. When the free standing block is adjacent to two other blocks forming a three block course, the open ended third cells of the block are now enclosed by the intermediate transverse webs of the adjacent blocks.

Each of the transverse webs may have a V- or U-shaped notch defined therein. The notch may have a curvilinear notch bottom disposed in a fixed pre-selected spatial relationship to the bottom surface of the block. A plurality of blocks may be oriented in a course with the open ended third cells of adjacent blocks being in registered communication with each other, the blocks in the course, together with vertically adjacent courses, defining the interior and exterior surfaces of the standing wall.

The standing wall may be assembled by placing a first cell core in each first cell. The first cell core may have a body portion substantially equal in size to the first cell with a trapezoidal shaped ear member integrally formed with the body portion at each end of the body member. The trapezoidal shaped ear members may complementary seat into the V- or U-shaped notch of the transverse web which is contiguous.

A second cell core is placed in the relatively closed second cell. Each second cell core may have a body portion substantially equal in size to the relatively closed second cell, the second cell core having a trapezoidal shaped ear member integrally formed with the body portion at each end for complementary seated engagement within the V- or U-shaped notch of the transverse web contiguous thereto. The ear members may extend outwardly from the body portion at a distance equal to one-half the notch axial length of V- or U-shaped slot.

A third cell core may be placed in one of the open ended third cells and the registered open ended third cell in the block adjacent thereto to interlock the adjacent blocks in fixed axial relationship to each other. The third cell core may be substantially identical in shape and size to the second cell core and the trapezoidal shaped ear members may be seated in V- or U-shaped slots of the contiguous transverse webs.

The foregoing steps may be repeated until an entire first row of blocks and cell cores are in place along an entire course and repeating the entire sequence for as many subsequent rows of blocks until the pre-selected length and height of the wall is achieved. Cell cores are omitted in running courses to provide for the insertion and grouting of horizontal rebar to form bond beams. Likewise cell cores or portions of cell cores, preferably second and third cell cores, are omitted from vertically adjacent cells to provide for the insertion and grouting of vertical rebar to form grout columns. A cap of grout or other structural cementious material can be poured on the top running course to compensate for accumulated elevation variations in the top running course, thereby providing a standing wall with a uniform, desired top elevation. Alignment and elevation variations of the running courses that comprise the wall may be addressed by the application of a surface bond that can be finished to a uniform and plumb finish. The penetration of the surface bond cementious material into the gaps between the blocks of a running course also may significantly strengthen the standing wall against sheer and lateral forces.

Other embodiments and other variations of the embodiments described above will be obvious to a person skilled in the art. Therefore, the foregoing is intended to be merely illustrative of the invention and the invention is limited only by the following claims and the doctrine of equivalents.

What is claimed is:

1. A cell core for installation in a cell of a hollow cored dry stack block, the block having a block top surface and a block bottom surface, the cell being bounded on two opposing sides by respective transverse webs, each transverse web having a v-shaped or u-shaped web notch with a notch bottom, the cell core having a compressibility, and the cell core comprising:

a tablet shaped body portion, the body portion having a top surface, a bottom surface, a first face surface, a second face surface, a first end surface, and a second end surface; and a pair of opposing trapezoidal shaped ear members, one ear member being integral with the first end surface and the other ear member being integral with the second end surface, each ear member having an ear base, and each ear member being dimensioned for insertion in one of the respective web notches to an inserted position and for formation of a notch gap between the ear base and the notch bottom upon insertion in the notch to accommodate crumbing which may accumulate in the web notch at or near the notch bottom during manufacturing of the block, each ear member providing for the cell core to be urged into a position in the cell providing that the core top surface is at or below the block top surface and the core bottom surface is at or above the block bottom surface when installed, providing, when the block is installed in a wall, for the block bottom surface to rest directly upon a block top surface of one or more blocks installed beneath the block in the wall and for a block bottom surface of more or more blocks installed above the block in the wall to rest directly upon the block top surface, providing for the elimination of gaps between successive courses of block, the trapezoidal shape and compressibility of the ear members accommodating dimensional variations in the web notches or variations in the inserted positions of the ear members in the web notches.

2. A cell core as recited in claim 1 wherein the first face surface or the second face surface, or both, are fluted.

3. A cell core as recited in claim 1 wherein the top surface has one or more spurs and the bottom surface has a corresponding number of recesses, the spurs being positioned to co-act with the recesses of another cell core placed in a staggered or stacked position on top of the cell core.

4. A cell core as recited in claim 1 wherein the ear base is concave.

5. A cell core as recited in claim 1 wherein the ear base is w-shaped.

6. A dry stack block assembly comprising:

dry stack block having a block top surface and a block bottom surface, the block comprising:

first and second parallel, rectangular side walls, and a rectangular central web, the central web being positioned between and parallel to the first side wall and the second side wall, wherein the first and second side walls and the central web each have a bottom edge located in a first plane, a top edge located in a second plane which is parallel to the first plane, a first end located in a third plane which is perpendicular to the first plane, and a second end located in a fourth plane which is parallel to the third plane;

first and second end transverse webs connecting the first ends and the second ends respectively of the first side wall and the central web in the third and fourth planes respectively, each of the first and second end transverse webs having an end web notch, each end web notch having an end notch top and an end notch bottom;

first and second intermediate transverse webs positioned between the third and fourth planes of the first and second end transverse webs and connecting the second side wall and the central web, the intermediate transverse webs each having an intermediate web notch, each intermediate web notch having an intermediate notch top and intermediate notch bottom; and a first cell core having a compressibility and being dimensioned for insertion in and mating with a first cell between the first side wall, the central web, the first end transverse web, and the second end transverse web, the first cell core being tablet shaped and having a body portion and a pair of trapezoidal shaped first ear members, the body portion having a top surface, a bottom surface, a first face surface, a second face surface, a first end surface, and a second end surface, one first ear member being integral with the first end surface and the other first ear member being integral with the second end surface, each first ear member having an ear base, and each first ear member being dimensioned for insertion in an end web notch to an inserted position and for formation of an end notch gap between the ear base and the respective end notch bottom upon insertion of the first ear member in the end web notch to accommodate crumbing which may accumulate in the web notch at or near the notch bottom during manufacturing of the block, each ear member providing for the cell core to be urged into a position in the cell providing that the core top surface is at or below the block top surface and the core bottom surface is at or above the block bottom surface when installed, providing, when the block is installed in a wall, for the block bottom surface to rest directly upon a block top surface of one or more blocks installed beneath the block in the wall and for a block bottom surface of more or more blocks installed above the block in the wall to rest directly upon the block top surface, providing for the elimination of gaps between successive courses of block, the trapezoidal shape and compressibility of the ear members accommodating dimensional variations in the web notches or variations in the inserted positions of the ear members in the web notches.

7. A dry stack block assembly as recited in claim 6 further comprising a second cell core dimensioned for insertion in and mating with a second cell between the second side wall, the central web, the first intermediate transverse web, and the second intermediate transverse web, the second cell core being tablet shaped and having a second body portion and a pair of trapezoidal shaped second ear members, the second body portion having a top surface, a bottom surface, a first face surface, a second face surface, a first end surface, and a second end surface, and one second ear member being integral with the first end surface and the other second ear member being integral with the second end surface, each second ear member having an ear base, and each second ear member being dimensioned for insertion in an intermediate web notch and for formation of an intermediate notch gap between the ear base and the respective intermediate notch bottom upon insertion of the second ear member in the intermediate web notch.

8. A dry stack block assembly as recited in claim 7 further comprising a pair of third cell cores dimensioned for insertion in and mating with a pair of third cells respectively, one third cell being formed between the second side wall, the central web, the first intermediate transverse web, and the first block end, and a second third cell being formed between the second side wall, the central web, the second intermediate transverse web and the second block end, each third cell core being tablet shaped and having a third body portion and a pair of trapezoidal shaped third ear members, the third body portion having a top surface, a bottom surface, a first face surface, a second face surface, a first end surface, and a second end surface, and one third ear member being integral with the first end surface and the other third ear member being integral with the second end surface, each third ear member having an ear base, and each third ear member being dimensioned for insertion in an intermediate web notch and for formation of an intermediate notch gap between the ear base and the respective intermediate notch bottom upon insertion of the third ear member in the intermediate web notch, each third cell core further being dimensioned to extend to and be inserted in and mate with a third cell of an adjacent dry stack block, thereby tying the dry stack block to each of the adjacent dry stack blocks respectively.

9. A dry stack block assembly as recited in claim 6 wherein the first cell core first face surface or the first cell core second face surface, or both, are fluted.

10. A dry stack block assembly as recited in claim 7 wherein the second cell core first face surface or the second cell core second face surface, or both, are fluted.

11. A dry stack block assembly as recited in claim 8 wherein the third cell core first face surface or the third cell core second face surface, or both, are fluted.

12. A dry stack block assembly as recited in claim 6 wherein the first cell core top surface has one or more spurs and the first cell core bottom surface has a corresponding number of recesses, the spurs being positioned to co-act with the recesses of another first cell core placed in a staggered or stacked position on top of the first cell core.

13. A dry stack block assembly as recited in claim 7 wherein the second cell core top surface has one or more spurs and the second cell core bottom surface has a corresponding number of recesses, the spurs being positioned to co-act with the recesses of another second or third cell core placed in a staggered or stacked position on top of the second cell core.

14. A dry stack block assembly as recited in claim 8 wherein the third cell core top surface has one or more spurs and the third cell core bottom surface has a corresponding number of recesses, the spurs being positioned to co-act with the recesses of another third or second cell core placed in a staggered or stacked position on top of the third cell core.

15. A dry stack block assembly as recited in claim 8 wherein the ear base of at least one of the first ear members, the second ear members, or the third ear members is concave.

16. A dry stack block assembly as recited in claim 8 wherein the ear base of at least one of the first ear members, the second ear members, or the third ear members is w-shaped.

17. A dry stack block wall system comprising a plurality of dry stack block assemblies arranged in a plurality of courses to form the wall system, wherein each dry stack block assembly comprises:

dry stack block having a block top surface and a block bottom surface, the block comprising:

first and second parallel, rectangular side walls, and a rectangular central web, the central-web being positioned between and parallel to the first side wall and the second side wall, wherein the first and second side walls and the central web each have a bottom edge located in a first plane, a top edge located in a second plane which is parallel to the first plane, a first end located in a third plane which is perpendicular to the first plane, and a second end located in a fourth plane which is parallel to the third plane;

first and second end transverse webs connecting the first ends and the second ends respectively of the first side wall and the central web in the third and fourth planes respectively, each of the first and second end transverse webs having an end web notch, each end web notch having an end notch top and an end notch bottom;

first and second intermediate transverse webs positioned between the third and fourth planes of the first and second end transverse webs and connecting the second side wall and the central web, the intermediate transverse webs each having an intermediate web notch, each intermediate web notch having an intermediate notch top and intermediate notch bottom; and a first cell core having a compressibility and being dimensioned for insertion in and mating with a first cell between the first side wall, the central web, the first end transverse web, and the second end transverse web, the first cell core being tablet shaped and having a body portion and a pair of trapezoidal shaped ear members, the body portion having a top surface, a bottom surface, a first face surface, a second face surface, a first end surface, and a second end surface, and one ear member being integral with the first end surface and the other ear member being integral with the second end surface, each first ear member having an ear base, and each first ear member being dimensioned for insertion in an end web notch to an inserted position and for formation of an end notch gap between the ear base and the respective end notch bottom upon insertion of the first ear member in the end web notch to accommodate crumbing which may accumulate in the web notch at or near the notch bottom during manufacturing of the block, each ear member providing for the cell core to be urged into a position in the cell providing that the core top surface is at or below the block top surface and the core bottom surface is at or above the block bottom surface when installed, providing, when the block is installed in a wall, for the block bottom surface to rest directly upon a block top surface of one or more blocks installed beneath the block in the wall and for a block bottom surface of more or more blocks installed above the block in the wall to rest directly upon the block top surface, providing for the elimination of gaps between successive courses of block, the trapezoidal shape and compressibility of the ear members accommodating dimensional variations in the web notches or variations in the inserted positions of the ear members in the web notches.

18. A dry stack block wall system as recited in claim 17 wherein each dry stack block assembly further comprises a second cell core dimensioned for insertion in and mating with a second cell between the second side wall, the central web, the first intermediate transverse web, and the second intermediate transverse web, the second cell core being tablet shaped and having a second body portion and a pair of trapezoidal shaped second ear members, the second body portion having a top surface, a bottom surface, a first face surface, a second face surface, a first end surface, and a second end surface, and one second ear member being integral with the first end surface and the other second ear member being integral with the second end surface, each second ear member having an ear base, and each second ear member being dimensioned for insertion in an intermediate web notch and for formation of an intermediate notch gap between the ear base and the respective intermediate notch bottom upon insertion of the second ear member in the intermediate web notch.

19. A dry stack block wall system as recited in claim 18 wherein the dry stack block assembly further comprises a pair of third cell cores dimensioned for insertion in and mating with a pair of third cells respectively, one third cell being formed between the second side wall, the central web, the first intermediate transverse web, and the first block end, and a second third cell being formed between the second side wall, the central web, the second intermediate transverse web and the second block end, each third cell core being tablet shaped and having a third body portion and a pair of trapezoidal shaped third ear members, the third body portion having a top surface, a bottom surface, a first face surface, a second face surface, a first end surface, and a second end surface, and one third ear member being integral with the first end surface and the other third ear member being integral with the second end surface, each third ear member having an ear base, and each third ear member being dimensioned for insertion in an intermediate web notch and for formation of an intermediate notch gap between the ear base and the respective intermediate notch bottom upon insertion of the third ear member in the intermediate web notch, each third cell core further being dimensioned to extend to and to be inserted in and mate with a third cell of an adjacent dry stack block, thereby tying the dry stack block to each of the adjacent dry stack blocks respectively.

20. A dry stack block wall system as recited in claim 17 wherein the first cell core first face surface or the cell core second face surface, or both, are fluted.

21. A dry stack block wall system as recited in claim 18 wherein the second cell core first face surface or the second cell core second face surface, or both, are fluted.

22. A dry stack block wall system as recited in claim 19 wherein the third cell core first face surface or the third cell core second face surface, or both, are fluted.

23. A dry stack block wall system as recited in claim 17 wherein the first cell core top surface has one or more spurs and the first cell core bottom surface has a corresponding number of recesses, the spurs being positioned to co-act with the recesses of another first cell core placed in a staggered or stacked position on top of the first cell core.

24. A dry stack block wall system as recited in claim 18 wherein the second cell core top surface has one or more spurs and the second cell core bottom surface has a corresponding number of recesses, the spurs being positioned to co-act with the recesses of another second or third cell core placed in a staggered or stacked position on top of the second cell core.

25. A dry stack block wall system as recited in claim 19 wherein the third cell core top surface has one or more spurs and the third cell core bottom surface has a corresponding number of recesses, the spurs being positioned to co-act with the recesses of another third or second cell core placed in a staggered or stacked position on top of the third cell core.

26. A dry stack block wall system as recited in claim 17, further comprising one or more block shims installed for leveling one or more blocks in a course.

27. A dry stack block wall system as recited in claim 17, further comprising a surface bond installed on the first side wall, the second side wall, or both, of a plurality of blocks.

28. A dry stack block wall system as recited in claim 17, wherein the courses of block assemblies include a top course, the top course having a course top, the dry stack wall system further comprising a leveling cap installed on the course top of the top course.

29. A dry stack block wall system as recited in claim 17, wherein the wall system further comprises a foundation and a plurality of reinforcing bars anchored to the foundation and extending through vertically aligned cells for which the respective cell cores have been omitted or removed in successive courses, the reinforcing bars being grouted in place in the vertically aligned cells, thereby forming a plurality of grout columns.

30. A dry stack block wall system as recited in claim 17, wherein the wall system further comprises a plurality of reinforcing bars extending through horizontally aligned cells for which the respective cell cores have been omitted or removed for a plurality of blocks of one or more courses, the reinforcing bars being grouted in place in the horizontally aligned cells, thereby forming one or more bond beams.

31. A dry stack block wall system as recited in claim 17, further comprising a plurality of mortar joints, a plurality of blocks having a mortar joint between the block and an adjacent block.

32. A dry stack block wall system as recited in claim 17 wherein the wall system has an exterior surface and the dry stack wall system further comprises a surface bond of cementious material installed on a portion or all of the exterior surface.

33. A dry stack block wall system as recited in claim 17 wherein the wall system has an interior surface and the dry stack wall system further comprises a surface bond of cementious material placed on a portion or all of the interior surface.

34. A dry stack block assembly as recited in claim 19 wherein the ear base of at least one of the first ear members, the second ear members, or the third ear members is concave.

35. A dry stack block assembly as recited in claim 19 wherein the ear base of at least one of the first ear members, the second ear members, or the third ear members is w-shaped.

36. A method for erecting a dry stacked block wall system, the wall system having an exterior surface and an interior surface, the method comprising the steps of:

(a) providing a plurality of hollow cell dry stack blocks, each dry stack block having a block top surface and a block bottom surface and each dry stack block comprising:

first and second parallel, rectangular side walls, and a rectangular central web, the central web being positioned between and parallel to the first side wall and the second side wall, wherein the first and second side walls and the central web each have a bottom edge located in a first plane, a top edge located in a second plane which is parallel to the first plane, a first end located in a third plane which is perpendicular to the first plane, and a second end located in a fourth plane which is parallel to the third plane;

first and second end transverse webs connecting the first ends and the second ends respectively of the first side wall and the central web in the third and fourth planes respectively, each of the first and second end transverse webs having an end web notch, each end web notch having an end notch top and an end notch bottom;

first and second intermediate transverse webs positioned between the third and fourth planes of the first and second end transverse webs and connecting the second side wall and the central web, the intermediate transverse webs each having an intermediate web notch, each intermediate web notch having an intermediate notch top and intermediate notch bottom; and (b) providing a plurality of first cell cores, each first cell core having a compressibility and being dimensioned for insertion in and mating with a first cell between the first side wall, the central web, the first end transverse web in one of the dry stack blocks, the first cell cores comprising:

tablet shaped body portion, the body portion having a top surface, a bottom surface, a first face surface, a second face surface, a first end surface, and a second end surface; and a pair of trapezoidal shaped first ear members, one ear member being integral with the first end surface and the other ear member being integral with the second end surface, each first ear member having an ear base, and each first ear member being dimensioned for insertion in an end web notch to an inserted position and for formation in an end notch gap between the ear base and the respective end notch bottom upon insertion of the first ear member in the end web notch to accommodate crumbing which may accumulate in the web notch at or near the notch bottom during manufacturing of the block, each ear member providing for the cell core to be urged into a position in the cell providing that the core top surface is at or below the block top surface and the core bottom surface is at or above the block bottom surface when installed, providing, when the block is installed in a wall, for the block bottom surface to rest directly upon a block top surface of one or more blocks installed beneath the block in the wall and for a block bottom surface of more or more blocks installed above the block in the wall to rest directly upon the block top surface, providing for the elimination of gaps between successive courses of block, the trapezoidal shape and compressibility of the ear members accommodating dimensional variations in the web notches or variations in the inserted positions of the ear members in the web notches.

(c) inserting first cell cores in a plurality of dry stack blocks;

(d) dry stacking a plurality of dry stack blocks to form the wall;

(e) installing vertical and horizontal reinforcing in the wall;

(f) grouting the vertical and horizontal reinforcing in the wall;

(g) applying a surface bond on the exterior surface or the interior surface, or both, of the wall.

37. A method for erecting a dry stacked block wall system as recited in claim 36 further providing and inserting in a plurality of dry stack blocks a second cell core dimensioned to substantially fill a second cell between the second side wall, the central web, the first intermediate transverse web, and the second intermediate transverse web, the second cell core being generally tablet shaped and having a second body portion and a pair of trapezoidal shaped second ear members, the second body portion having a top surface, a bottom surface, a first face surface, a second face surface, a first end surface, and a second end surface, and one second ear member being integral with the first end surface and the other second ear member being integral with the second end surface, each second ear member having an ear base, and each second ear member being dimensioned for insertion in an intermediate web notch and for formation of an intermediate notch gap between the ear base and the respective intermediate notch bottom upon insertion of the second ear member in the intermediate web notch.

38. A method for erecting a dry stacked block wall system as recited in claim 37 further providing and inserting in a plurality of dry stack blocks a pair of third cell cores dimensioned for insertion in and mating with a pair of third cells respectively, one third cell being formed between the second side wall, the central web, the first intermediate transverse web, and the first block end, and a second third cell being formed between the second side wall, the central web, the second intermediate transverse web and the second block end, each third cell core being tablet shaped and having a third body portion and a pair of trapezoidal shaped third ear members, the third body portion having a top surface, a bottom surface, a first face surface, a second face surface, a first end surface, and a second end surface, and one third ear member being integral with the first end surface and the other third ear member being integral with the second end surface, each third ear member having an ear base, and each third ear member being dimensioned for insertion in an intermediate web notch and for formation of an intermediate notch gap between the ear base and the respective intermediate notch bottom upon insertion of the third ear member in the intermediate web notch, each third cell core further being dimensioned to extend to and to be inserted in and mate with a third cell of an adjacent dry stack block, thereby tying the dry stack block to each of the adjacent dry stack blocks respectively.

39. A method for erecting a dry stacked block wall system as recited in claim 36 wherein the first cell core first face surface or the cell core second face surface, or both, are fluted.

40. A method for erecting a dry stacked block wall system as recited in claim 37 wherein the second cell core first face surface or the second cell core second face surface, or both, are fluted.

41. A method for erecting a dry stacked block wall system as recited in claim 38 wherein the third cell core first face surface or the third cell core second face surface, or both, are fluted.

42. A method for erecting a dry stacked block wall system as recited in claim 36 wherein the first cell core top surface has one or more spurs and the first cell core bottom surface has a corresponding number of recesses, the spurs being positioned to co-act with the recesses of another first cell core placed in a staggered or stacked position on top of the first cell core.

43. A method for erecting a dry stacked block wall system as recited in claim 37 wherein the second cell core top surface has one or more spurs and the second cell core bottom surface has a corresponding number of recesses, the spurs being positioned to co-act with the recesses of another second or third cell core placed in a staggered or stacked position on top of the second cell core.

44. A method for erecting a dry stacked block wall system as recited in claim 38 wherein the third cell core top surface has one or more spurs and the third cell core bottom surface has a corresponding number of recesses, the spurs being positioned to co-act with the recesses of another third or second cell core placed in a staggered or stacked position on top of the third cell core.

45. A method for erecting a dry stacked block wall system as recited in claim 36, further comprising inserting block shims beneath one or more dry stack blocks in a course as needed for leveling the plurality of blocks in the course.

46. A method for erecting a dry stacked block wall system as recited in claim 36, further comprising applying a surface bonding material adjacent to one of the first and third spaced, parallel, rectangular side walls.

47. A method for erecting a dry stacked block wall system as recited in claim 36, further comprising applying a leveling cap on the top course of the plurality of courses.

48. A method for erecting a dry stacked block wall system as recited in claim 36 wherein the wall system is installed on a foundation, a plurality of reinforcing bars anchored to the foundation and extended through vertically aligned cells for which the respective cell cores have been omitted or removed in successive courses, and the reinforcing bars are grouted in place in the vertically aligned cells, thereby forming a plurality of grout columns.

49. A method for erecting a dry stacked block wall system as recited in claim 36 wherein the wall system has an exterior surface and the method further comprises applying a surface bond of cementious material on a portion or all of the exterior surface.

50. A method for erecting a dry stacked block wall system as recited in claim 36 wherein the wall system has an interior surface and the method further comprises applying a surface bond of cementious material on a portion or all of the interior surface.

51. A method for erecting a dry stacked block wall system as recited in claim 36 further comprising extending a plurality of reinforcing bars through horizontally aligned cells for which the respective cell cores have been omitted or removed for a plurality of blocks of one or more courses, and grouting the reinforcing bars in place in the horizontally aligned cells, thereby forming one or more bond beams.

52. A method for erecting a dry stacked block wall system as recited in claim 36 further comprising installing a plurality of mortar joints, a plurality of blocks having a mortar joint between the block and an adjacent block.

53. A method for erecting a dry stacked block wall system as recited in claim 36 wherein the ear base of at least one of the first ear members, the second ear members, or the third ear members is concave.

54. A method for erecting a dry stacked block wall system as recited in claim 36 wherein the ear base of at least one of the first ear members, the second ear members, or the third ear members is w-shaped.

55. A dry stack block assembly comprising:

a dry stack block having a block top surface and a block bottom surface, the block comprising:

first and second parallel, rectangular side walls, wherein the first and second side walls each have a bottom edge located in a first plane, a top edge located in a second plane which is parallel to the first plane, a first block end located in a third plane which is perpendicular to the first plane, and a second block end located in a fourth plane which is parallel to the third plane;

first and second transverse webs connecting the first side wall to the second side wall, the transverse webs being positioned between the third plane and the fourth plane and being generally perpendicular to the first plane and the second plane, the transverse webs each having a web notch, each web notch having a notch top and a notch bottom; and a cell core having a compressibility and being dimensioned for insertion in and mating with a cell between the first side wall, the second side wall, the first transverse web and the second transverse web, the cell core being tablet shaped and having a body portion and a pair of trapezoidal shaped ear members, the body portion having a top surface, a bottom surface, a first face surface, a second face surface, a first end surface, and a second end surface, one ear member being integral with the first end surface and the other ear member being integral with the second end surface, each ear member having an ear base, and each ear member being dimensioned for insertion in an end web notch to an inserted position and for formation of a notch gap between the ear base and the respective notch bottom upon insertion of the ear member in the end web notch to accommodate crumbing which may accumulate in the web notch at or near the notch bottom during manufacturing of the block, each ear member providing for the cell core to be urged into a position in the cell providing that the core top surface is at or below the block top surface and the core bottom surface is at or above the block bottom surface when installed, providing, when the block is installed in a wall, for the block bottom surface to rest directly upon a block top surface of one or more blocks installed beneath the block in the wall and for a block bottom surface of more or more blocks installed above the block in the wall to rest directly upon the block top surface, providing for the elimination of gaps between successive courses of block, the trapezoidal shape and compressibility of the ear members accommodating dimensional variations in the web notches or variations in the inserted positions of the ear members in the web notches.

56. A dry stack block assembly as recited in claim 55 further comprising a pair of end cell cores dimensioned for insertion in and mating with a pair of end cells respectively, one end cell being formed between the first side wall, the second side wall, the first transverse web, and the first block end, and a second end cell being formed between the first side wall, the second side wall, the second transverse web and the second block end, each end cell core being tablet shaped and having a body portion and a pair of trapezoidal shaped ear members, the body portion having a top surface, a bottom surface, a first face surface, a second face surface, a first end surface, and a second end surface, and one ear member being integral with the first end surface and the other ear member being integral with the second end surface, each ear member having an ear base, and each ear member being dimensioned for insertion in a web notch and for formation of an intermediate notch gap between the ear base and the respective intermediate notch bottom upon insertion of the ear member in the web notch, each end cell core further being dimensioned to extend to and to be inserted in and mate with an end cell of an adjacent dry stack block, thereby tying the dry stack block to each of the adjacent dry stack blocks respectively.

* * * * *